United States Patent [19]

Svensson

[11] 4,047,670

[45] Sept. 13, 1977

[54] KNIFE DEVICE FOR A CHOPPER

[75] Inventor: Nils David Svensson, Hammaro, Sweden

[73] Assignee: Aktiebolaget Iggesunds Bruk, Sweden

[21] Appl. No.: 690,230

[22] Filed: May 26, 1976

Related U.S. Application Data

[63] Continuation of Ser. No. 561,507, March 24, 1975, abandoned.

[51] Int. Cl.[2] ..... B02C 18/18

[52] U.S. Cl. ..... 241/92; 144/162 R; 144/176; 144/235; 241/298

[58] Field of Search ..... 241/92, 189 R, 278 R, 241/282.2, 298; 144/162 R, 162 A, 162 B, 176, 231, 235

[56] References Cited

U.S. PATENT DOCUMENTS

| | | | |
|---|---|---|---|
| 3,000,578 | 9/1961 | Riches et al. | 241/92 |
| 3,542,302 | 11/1970 | Salzmann | 241/298 |
| 3,559,705 | 2/1971 | Salzmann | 144/162 R |
| 3,572,594 | 5/1971 | Kershaw | 241/92 X |
| 3,608,841 | 9/1971 | Wageneder | 241/189 R |
| 3,844,489 | 10/1974 | Strong | 241/92 X |
| 3,981,337 | 9/1976 | Sundstrom | 241/92 X |

*Primary Examiner*—Roy Lake
*Assistant Examiner*—Howard N. Goldberg
*Attorney, Agent, or Firm*—A. Yates Dowell, Jr.

[57] ABSTRACT

A rotary cutting apparatus having cutters or knife devices which are provided with angularly disposed contact surfaces and which devices are mounted with the contact surfaces in cooperative engagement with angularly disposed supporting or clamping surfaces of opposed knife support members.

4 Claims, 3 Drawing Figures

KNIFE DEVICE FOR A CHOPPER

Figure 1:
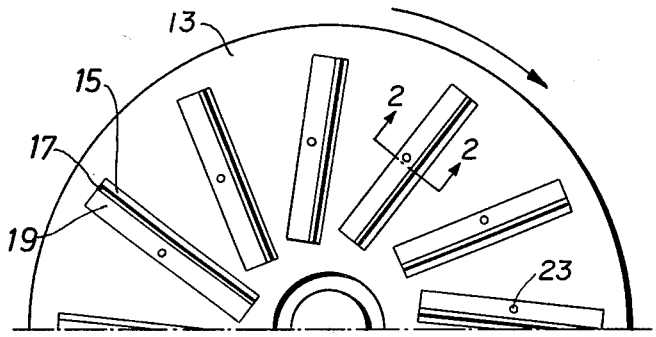

This is a continuation of application Ser. No. 561,507 filed Mar. 24, 1975, now abandoned.

This invention relates to a knife device for use with a chopper having a rotatable chopper disk with a plurality of radially spaced chip openings therethrough. The knife device includes one or more knives which are mounted between knife holders and chip guides which are essentially radially disposed adjacent the chip openings and attached to the input surface of the chopper disk. Each knife has at least one cutting edge which extends along the chip opening. The knife holders and chip guides include at least two flat contact or blade engaging surfaces forming an angle with each other. The structure of the knives is such that they are cooperatively received and clamped between the flat angularly disposed blade engaging surfaces of the knife holders and the opposing flat angularly disposed blade engaging surfaces of the chip guides.

Choppers having rotatable chopper disks having openings through which chopped material or chips may pass and which include knife devices attached along the edges of the openings are known in the art. Such a chopper is disclosed in Swedish Pat. No. 116,324 and includes a knife clamped between a knife holder and a chip guide.

After varying amounts of use, the knives of a chopper become worn or dulled and therefore must be replaced by new or resharpened knives. The wear on the knife edges is effected both by solid impurities accompanying wood, or other material being chopped, and by the fact that during the chopping operation the edges of the knives become heated. A knife edge is often heated to a higher temperature than expected because the conductance of the heat from the knife has been reduced. Such interference with the heat conduction from the knife edge may occur as, for example, when the wood or other material particles or impurities penetrate between the knife and the knife holding or supporting means during the cutting operation. The entrapped material thereby acts as insulation, reducing the conductance of heat from the knife. Further, with the increased temperature, the penetrating material will become more plastic, thereby favoring the penetration of the material between the knife and the knife holding means.

The object of this invention is to provide a knife device having a firm attachment for the knife as well as one having good heat conductivity. The invention provides a knife device having knife supporting contact surfaces which are so designed that the knife is firmly held in the correct position while heat insulating material is prevented from penetrating therebetween. Furthermore the contact surfaces are designed so as to provide as large an area as is practically possible for the conductance of heat from the knife.

In order to obtain both a close contact with, and an increased surface pressure between, the knife and its holding devices, such components are so designed and joined to each other that all forces created in connection with the chopping work will contribute to urge the knife and its holding means together. The knife supporting contact surfaces overlap each other in such a manner that material passing along the edge of the knife will not penetrate between opposed engaging portions of the contact surfaces. Therefore, the areas between the knife and its supports are sheltered from the flow of the chips or other material separated by the knife and passing through the opening of the chopper disk, and the knife is securely reinforced to prevent any slippage thereof relative to the knife supports as logs or other materials are being chopped. Further, not only are the risks of penetration, in regard to heat insulating material, between the contact surfaces reduced, but the clean and closely maintained engagement between the contact surfaces of the knife and its holding means allows for good heat conduction.

Also, since the broad sides of the knives are each provided with two flat contact surfaces forming an angle with each other there will result a better contact between the knife and its holding means as compared to the contact obtained by only one flat contact surface on each side.

A knife device according to the invention has an extended usefulness, prior to the replacement or resharpening thereof, in part due to the increased effective heat conduction from the knife edge. It is also possible to obtain a knife having a smaller cross-sectional area thereby resulting in a lighter weight knife which can be manufactured with a decrease in material consumption.

The new knife attachment makes it possible to obtain two knife edges facing opposite directions, whereby said knife can be turned and the time interval between resharpenings or replacements is doubled. The design of the knife attachment and the low weight of the knife imply that it will be relatiely simple to replace the knives of the chopper. In connection with the large chopper disks and long knives each knife may suitably be divided into several unit lengths. Then, when a knife is replaced only those lengths thereof which are damaged or worn have to be replaced.

Below the invention is described more in detail with reference to the figures of the enclosed drawings.

FIG. 1 discloses a side view of a certain part of a rotatable chopper disk having knife devices and through-passing openings, said view being taken from the feeding side.

Figure 2:
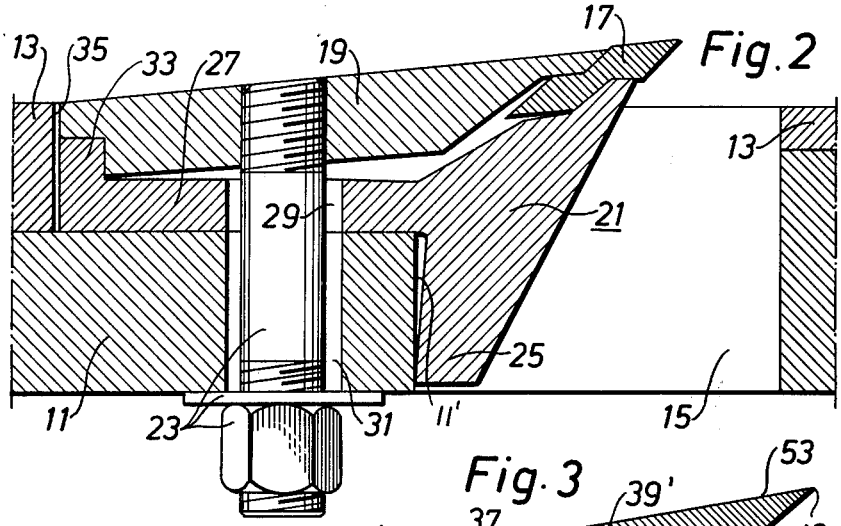

FIG. 2 discloses a cross-section of a knife and the knife attachment, along line 2—2 of FIG. 1.

Figure 3:
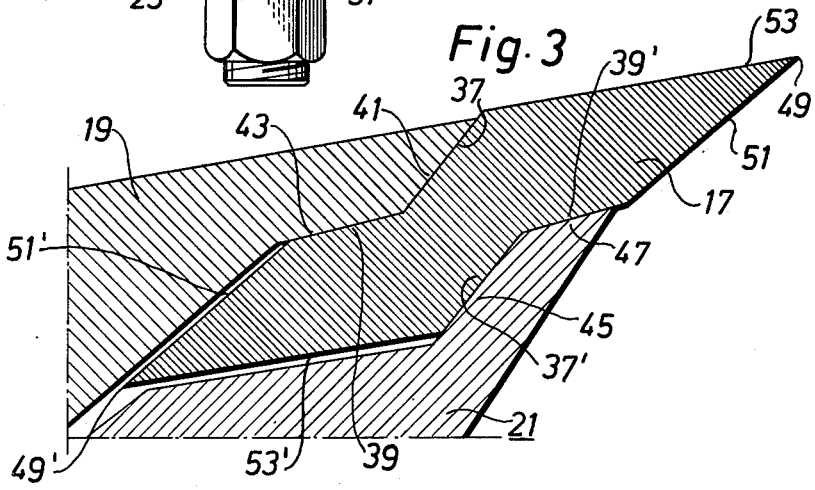

FIG. 3 discloses — in a larger scale than FIG. 2 — the cross-section of the knife and the contact thereof against the chip guide and the knife holder.

FIGS. 1 and 2 disclose parts of a chopper disk 11 having wear plates 13 as well as openins 15 for the passage of chips.

Knives 17 are clamped between the knife holder 19 and the chip guide 21. Each knife holder 19 is provided with one or more screw means 23 by means of which said holder can be brought to press the knife 17 against the chip guide 21. The outer surface of the screw means 23 and the knife holder 19 form a generally planar or flat surface. The chip guide 21 includes two extensions 25, 27 resting against the chopper disk 11. One extension 25 extends through the opening 15 and rests against the wall 11' of the chopper disk 11 adjacent the outlet or discharge of said opening 15. The other extension 27 on the chip guide 21 is essentially perpendicular to the first extension 25 and rests against the plane of the chopper disk 11 at the input side along the rear edge of the opening 15, as seen in the rotational direction of the chopper disk 11. The chip guide 21 and the chopper disk 11 include openings or bores 29, 31, respectively, through which the screw means 23, with clearance, extend from the knife holder 19 to the outlet side of the chopper disk 11. The rear end of the knife holder 19, as seen in rotational direction of the chopper disk, rests against a support 33 on the extension 27 of the chip guide. The extension having the support 33 and the knife holder 19 is separated by a narrow gap 35 from the wear plate 13.

As best follows from FIG. 3 the knife 17 includes two flat contact surfaces 37, 39 in the direction of the knife holder 19 which form an angle with each other and rest against corresponding contact surfaces 41 and 43 of the knife holder 19. In the direction of the chip guide 21 the knife 17 includes two flat contact surfaces 37', 39' forming an angle with each other and resting against corresponding contact surfaces 45 and 47 of the chip guide 21. The knife 17 includes two cutting edges 49 and 49' and is so designed that an imaginary straight line between the edges divides the cross-section area of the knife into two congruent halves one of which is rotated half a turn in relation to the other one. The edges 49 and 49' are formed by the intersection of two pairs of essentially flat edge surfaces 51, 53 and 51', 53', respectively.

When mounting the knives 17 the nuts of the screw means 23 only have to be loosened to such an extent that it will be possible to insert the knives 17 between the knife holders 19 and the chip guides 21. The nuts of the screw means 23 are firmly tightened so that a close contact with a high surface pressure will result between the contact surfaces 37, 39; 41, 43 and 37', 39'; 45, 47, respectively.

In connection with chopping all forces acting on the chip guide 21 and the knife holder 19 will cooperate in order to clamp the knife 17. Since the rear end of the knife holder 19 is applied against the support 33 and since the gap 35 makes it possible to displace the chip guide 21 and the knife holder 19 a small distance backwards, a bending moment will result on that part of the chip guide 21 extending between the contact of the opening 15 and the knife 17. The bending moment forces the contact surfaces 45, 47 of the chip 21 against the corresponding contact surfaces 37', 39' of the knife. Thereby, also, the surface pressure between the contact surfaces 37, 39 of the knife and the contact surfaces 41, 43 of the knife holder 19 is increased.

As best follows from FIG. 3 the contact surface 39' of the knife extends beyond the contact surface 47 of the chip guide 21 in the direction of movement of the knife which means that the contact between the surfaces is sheltered from the chips and other material including resin and other impurities separated by the knife 17 and passing through the opening 15. Thus, the risk of penetration of particles between the knife 17 and the chip guide 21 is practically non-existant. In the same way the contact surface 37 of the knife 17 extends beyond the contact surface 41 of the knife holder 19, thereby preventing the penetration of foreign particles between the knife 17 and the knife holder 19.

The knife 17 includes two cutting edges 49 and 49' and has such a cross-section that a straight line between the edges divides said section into two congruent halves rotated a half turn in relation to each other. Hereby the knife is turnable and it will be possible to perform an edge replacement by turning the knife 17. In connection with large chopper disks having long knives each knife 17 can be divided into serveral unit lengths. In connection with an edge replacement, only those lengths which are worn or damaged have to be turned or replaced.

I claim:

1. An apparatus for chopping material comprising a rotatable chopper disk having at least one radially disposed opening extending therethrough, a first knife holding means mounted on said disk and having a chip guiding surface located within said radial opening, said first knife holding means having a first knife engaging portion including at least two angularly disposed knife engaging surfaces, a second knife holding means mounted on said first knife holding means and having an outer wall disposed generally along the radial face of said disk, said second knife holding means having a second knife engaging portion including at least two angularly disposed knife engaging surfaces, a knife mounted between said first and second knife holding means adjacent said opening, said knife having at least one cutting edge disposed outwardly from a radial face of said disk and defined by the intersection of first and second knife edge surfaces, said knife having first and second contact surfaces, each of said contact surfaces having first and second angularly disposed surface portions for cooperative engagement with said first and second knife engaging surfaces of said first and second knife holding means, respectively, said first angularly disposed surface portion of said first contact surface extending outwardly beyond said chip guiding surface of said first knife holding means and intersecting said first knife edge surface so that the plane of said first knife edge surface is located outwardly of the plane of said chip guiding surface, said first angularly disposed surface portion of said second contact surface extending outwardly beyond said outer wall of said second knife holding means and intersecting said second knife edge surface so that the plane of said second knife edge surface is located outwardly of the plane of said outer wall of said second knife holding means, and means for securing said knife between said first and second knife holding means, whereby the location of said first and second knife edge surfaces relative to the planes of said chip guiding surface of said first knife holding means and said outer wall of said second knife holding means, respectively, substantially prevents material from penetrating between said knife and said first and second knife holding means.

2. The structure of claim 1 in which said first knife holding means includes first and second portions which are generally perpendicularly disposed with respect to one another, said first portion including said chip guide means and said second portion of said first knife holding means being mounted in a generally parallel relationship with said chopper disk.

3. The structure of claim 2 in which said second knife holding means includes a rear portion remote from said second contact surfaces, said second portion of said first knife holding means including a support portion extending generally normal thereto, and said rear portion of said second knife holding means engages said support portion of said first knife holding means.

4. The structure of claim 3 including a wear plate mounted on said chopper disk means, said wear plate having walled portions adjacent to said rear portion of said second knife holding means and said support portion of said first knife holding means.

* * * * *